US009650224B2

(12) United States Patent
Braschoss et al.

(10) Patent No.: US 9,650,224 B2
(45) Date of Patent: May 16, 2017

(54) SYSTEM AND METHOD FOR FOLDING PRINTED SHEETS

(71) Applicant: Mueller Martini Holding AG, Hergiswil (CH)

(72) Inventors: Peter Braschoss, Zofingen (CN); Hanspeter Duss, Buchs (CH); Christoph Gysin, Ormalingen (CH); Martin Thurnherr, Nebikon (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 709 days.

(21) Appl. No.: 14/067,793

(22) Filed: Oct. 30, 2013

(65) Prior Publication Data

US 2014/0121093 A1 May 1, 2014

(30) Foreign Application Priority Data

Oct. 30, 2012 (CH) ..... 2180/12

(51) Int. Cl.

| | |
|---|---|
| ***B65H 45/12*** | (2006.01) |
| ***B65H 45/04*** | (2006.01) |
| ***B31B 1/52*** | (2006.01) |
| ***B65H 45/18*** | (2006.01) |

(52) U.S. Cl.

CPC ..... *B65H 45/12* (2013.01); *B31B 1/52* (2013.01); *B65H 45/04* (2013.01); *B65H 45/18* (2013.01); *B65H 2406/12* (2013.01)

(58) Field of Classification Search

CPC ..... B31B 1/52; B65H 45/04; B65H 45/12; B65H 45/18

USPC ..... 270/32; 493/22, 23, 35, 36, 434, 435, 493/437, 454

See application file for complete search history.

(56) References Cited

U.S. PATENT DOCUMENTS

| | | | | |
|---|---|---|---|---|
| 3,419,261 | A * | 12/1968 | Sjostrom | D06F 89/00 493/23 |
| 3,578,311 | A * | 5/1971 | Wood | B65H 45/12 493/13 |
| 4,053,150 | A * | 10/1977 | Lane | B65H 45/18 493/417 |
| 4,624,095 | A * | 11/1986 | Gietman, Jr. | B65H 45/18 493/444 |

(Continued)

FOREIGN PATENT DOCUMENTS

| | | | |
|---|---|---|---|
| CN | 102815574 | A | 12/2012 |
| DE | 3544495 | A1 | 6/1987 |

(Continued)

OTHER PUBLICATIONS

Search Report issued in European Application 13190199 dated Feb. 10, 2014.

European Search Report of CH 21792012 dated Feb. 15, 2013.

*Primary Examiner* — Leslie A Nicholson, III

(74) *Attorney, Agent, or Firm* — FisherBroyles, LLP; Robert Kinberg

(57) ABSTRACT

An apparatus for folding of print sheets includes a compressed air device that comprises at least two segments with respectively at least one exit opening having a cross-sectional surface and directed toward a folding gap of two folding rollers. Each segment is connected to a compressed air source and a control unit, includes at least one control element and is embodied to be activated separately with compressed air.

19 Claims, 5 Drawing Sheets

(56) References Cited

U.S. PATENT DOCUMENTS

| | | | | |
|---|---|---|---|---|
| 5,518,574 | A * | 5/1996 | Yates | B05C 5/0212 156/356 |
| 6,309,336 | B1 * | 10/2001 | Muessig | B65H 45/12 493/405 |
| 2002/0140793 | A1 * | 10/2002 | Summers | B65H 45/18 347/101 |

FOREIGN PATENT DOCUMENTS

| | | | |
|---|---|---|---|
| DE | 10238502 | A1 | 2/2004 |
| GB | 190912124 | A | 3/1910 |

* cited by examiner

SYSTEM AND METHOD FOR FOLDING PRINTED SHEETS

CROSS-REFERENCE TO RELATED APPLICATION

This application claims the priority of Swiss Patent Application No: 02180/12, filed on Oct. 30, 2012, the subject matter of which is incorporated herein by reference.

BACKGROUND OF THE INVENTION

The invention relates to an apparatus and method for folding of print sheets or signatures.

For the further processing of printed-on sheets of paper, so-called print sheets which comprise two or more printed pages, these print sheets are folded over at least once under the effect of pressure to form a sharp edge, meaning they are folded to the format of the finished printed product along a previously perforated or grooved folding line, or also along a non-prepared folding line, according to a predetermined folding pattern. Relative to the feeding direction for the print sheets, devices for the cross-folding as well as the longitudinal folding are used for this, wherein a single device, multiple devices or also a combination thereof can be arranged in a folding machine. The folding can be realized with the aid of a so-called pocket folding and/or sword folding principle. Regardless of the type of apparatus that is used and the respective method, the precision of each individual fold is decisive for the quality of the printed product to be produced.

German patent document DE 3544495 A1 discloses a folding apparatus for cross-folding which operates based on the sword-folding principle. With this apparatus, respectively one print sheet is supplied with the aid of feed rollers in a feeding direction to a folding table and against an end stop arranged thereon. The folding table contains an opening, embodied transverse to the feeding direction, above which a mechanically operated folding sword is arranged. Two folding rollers are arranged below the folding table, in the region of the opening and parallel thereto. As soon as the front edge of the print sheet to be folded impacts with an end stop that projects upward from the folding table, as seen in feeding direction, this triggers the lowering of the folding sword onto the print sheet, positioned on the folding table. The folding sword presses against the folding line, meaning against an imaginary straight line on the print sheet along which the sheet is to be folded, and thus moves the print sheet through the opening of the folding table and toward the folding rollers. The print sheet is then gripped by the folding rollers and pulled into the folding gap, formed between the rollers, and is then folded and also compressed along the folding line. The print sheet folded in this way is subsequently conveyed away in a downward direction with the aid of the folding rollers. Furthermore known are folding machines having a folding sword arranged below the folding table and folding rollers arranged above the folding table for which the folded print sheet is respectively conveyed away in an upward direction.

Regardless of the specific arrangement, a mechanical sword of this type requires very precise and involved geometric adjustments. Adapting the length of the folding sword to the format of the print sheets can furthermore be realized only with great expenditure. In addition, a mechanical folding sword requires a relatively large structural area, but is nevertheless hard to access. Owing to the required high folding capacity, the folding sword must move at the highest possible speed and thus impacts at a relatively high speed with the print sheet. To avoid contact with the folding rollers and to clear the space on the folding table as quickly as possible for supplying the following print sheet, the folding sword must reverse its movement direction just prior to reaching the folding rollers, so as to move in the direction opposite to the previous lowering movement. The print sheet to be folded is therefore in an undefined movement shortly before takeover through the folding rollers. The print sheet consequently can deviate from the specified movement path and may not be gripped by the folding rollers, thereby resulting in the continuous danger of jamming of the successively supplied print sheets. In addition, print sheets arriving in a position that is offset from the folding position can be folded only with high technical expenditure along the predetermined folding line. Finally, the forming of so-called dog ears, meaning the folding over of the ends of the print sheets at high speeds, can hardly be controlled because corresponding guide elements are only conditionally usable owing to the space required for the mechanical sword. Accordingly, the danger of reducing the quality of the later printed product can be reduced with high technical expenditure, but cannot be eliminated.

When using an also known rotating folding sword, which is suitable for high folding capacities, the folding point in time can hardly be varied because of the mass inertia of the apparatus.

German patent document DE 10238502 A1 discloses a suitable method and apparatus for the cross-folding or the longitudinal folding of respectively one print sheet, wherein a pneumatic sword is used instead of a mechanical one, meaning a compressed air device consisting of a tube with preferably downward directed exit openings. The print sheet is supplied to this apparatus while positioned in a guide plane and is thus made available in a folding position where the predetermined folding line is located below the exit openings of the compressed air device. At that moment, a control unit transmits a trigger pulse to the compressed air device for issuing a strong blast of compressed air, e.g. measuring several hundred Bar, which is directed toward the folding line on the print sheet. As a result of the effect of this compressed-air blast, the print sheet is guided along its folding line into the folding gap between the folding rollers. Since a non-defined movement path of the print sheet is precluded in this way, the danger of a lower quality of the final printed product can thus be reduced as compared to using a mechanical sword.

Owing to the design and arrangement of the compressed air device, however, this solution does not permit an adaptation to changed formats of print sheets to be folded successively. Thus, a print sheet that follows a small format print sheet could already be in the region of the compressed air device before the previous print sheet has been conveyed further to the folding rollers. The compressed air device would thus have to be exchanged which, however, would be time-consuming and costly. Alternatively, the spacing between successively following print sheets could also be adapted to the changing format. However, this would require higher transporting speeds and thus also result in disadvantages for the processing.

When creating a cross fold immediately prior to creating a longitudinal fold, the cross folding operation results in a gap between the folded print sheets, with the mechanical as well as with the pneumatic sword, wherein this gap corresponds to the length of the respective print sheet. When using a variable format, meaning sheets having a variable length which are to be folded successively, the relatively stable folding edge of the cross fold cannot be moved to a fixed position that is defined as advantageous for transferring the print sheet to the following processing machine because the folding edge of a following, shorter print sheet is otherwise already located in the sword folding region, thus making it impossible to fold only the preceding print sheet. As a result, an involved and adjustable end stop is necessary. In addition, the lowered mechanical sword as well as the compressed air flow from the pneumatic sword, which is directed onto the print sheet to be folded, prevents an immediate feeding of the following print sheet and thus a quicker production.

Especially for the further processing of sheets that are printed sequentially with the aid of digital printers, which can be used to print the sheets in the predetermined sequence for the finished printed product and thus allow producing the products in relatively small piece numbers up to a single copy, successively following print sheets frequently have different formats which can be folded with the apparatuses and methods known from the prior art only after the compressed air device has been exchanged or the spacing between successively following print sheets has been adapted. In addition to the aforementioned disadvantages of the pneumatic sword, this also makes more difficult or impossible an automation of the folding process.

Finally, digital printers for transferring the print image directly from a computer to the printer and without the use of static print forms are nowadays used to print increasingly higher numbers of print material per time unit. As compared to the past, this poses clearly higher requirements for the quality as well as the capacity of the devices used for the processing, for example the folding devices.

SUMMARY OF THE INVENTION

It is therefore an object of the invention to create an apparatus and a method for the folding of print sheets which are suitable to allow an easy and cost-effective adaptation to changing formats of successively arriving print sheets and to make possible an automation of the folding process, meaning they are suitable for the further processing of sequentially printed sheets with the aid of digital printers.

According to one embodiment of the invention there is provided an apparatus for folding of a print sheet, comprising: at least one first guide element defining a guide plane in which the print sheet is made available; at least two folding rollers, arranged on a first side of the guide plane and respectively provided with one rotational axis, wherein a folding gap is defined between the at least two folding rollers for the print sheet to be folded when in the folding position and the rotational axes are oriented parallel to each other and substantially parallel to the guide plane; a compressed air source; a control unit; and a compressed air device arranged in a region of the folding gap on a second side of the guide plane opposite the first side of the guide plane and essentially parallel to the rotational axes of the folding rollers, wherein the compressed air device includes at least two segments respectively connected with the compressed air source and the control unit, each segment has at least one exit opening with a cross-sectional surface for the compressed air that is focused onto the folding gap, each segment has at least one control element, and each segment is configured to be separately activated with compressed air.

According to another embodiment of the invention, there is provided a method for folding print sheets, comprising: making available a print sheet to a folding position located in a guide plane adjacent a gap between two folding rollers located on one side of the guide plane and having respectively one rotational axis, wherein the rotational axes are oriented parallel to each other and parallel to the guide plane; admitting the print sheet in the region of the folding gap with a compressed air blast coming from a second side of the guide plane that is located opposite the first side, the compressed air blast coming from a compressed air device that includes at least two segments respectively connected with a compressed air source and a control unit, each segment has at least one exit opening with a cross-sectional surface for the compressed air that is focused onto the folding gap, each segment has at least one control element, and each segment is configured to be separately activated with compressed air, wherein the print sheet is transported under the effect of the compressed air blast, triggered by the control unit out of the guide plane to the rotating folding rollers; and folding the print sheet on the first side of the guide plane between at least the two rotating folding rollers;

As a result of the segmenting of the compressed air device, at least two regions of the apparatus, arranged in the feeding direction side-by-side or one behind the other, can be admitted individually with compressed air. It is therefore possible to supply only that segment with compressed air which corresponds to the format of the available print sheet. For a print sheet having a small format, for example, only one segment or part of a segment may be admitted with compressed air, so that the blast of compressed air onto the available print sheet comes only from the exit openings of this one segment or partial segment. In the same way, at least two successively supplied print sheets in the apparatus can advantageously be processed identically as well as differently, corresponding to their format. By correspondingly admitting at least one of the control elements of at least one of the segments, the compressed air blast from this at least one segment, from several segments, or from the whole compressed air device can be metered quickly and easily to correspond to the format of the available print sheet and a good folding quality as well as a high folding capacity can be achieved over the complete spectrum of print sheets to be folded.

According to another embodiment of the method, the control unit triggers a blast of compressed air coming from at least one exit opening of at least one of the segments of the compressed air device which hits the available print sheet. By correspondingly admitting at least one of the segments, the blast of compressed air from the compressed air device can be metered easily and fast to match the format of a currently available print sheet to be folded in the folding position, and a good folding quality as well as a high folding capacity can be achieved over the complete spectrum of print sheets to be folded.

In addition, asymmetric print sheets with a differing mass distribution, meaning sheets with different page numbers on both sides of an existing fold, can be transported evenly to the folding rollers by correspondingly admitting the respective segments. As a result, such print sheets can also be cross folded with high folding quality.

In addition, the apparatus according to the invention for making available the print sheet can supply print sheets in a first or second feeding direction, extending either essentially at a right angle or essentially parallel to the rotational axes of the folding rollers, wherein the segments of the compressed air device are arranged side-by-side in the first feeding direction or one behind the other in the second feeding direction. Thus, the print sheet can advantageously be supplied in a first feeding direction, essentially at a right angle to the rotational axes of the folding roller, and can be admitted with compressed air crosswise to the first feeding direction, or the print sheet can be made available in a second feeding direction, extending essentially parallel to the rotational axes of the folding rollers, and can be admitted with a compressed air blast along the second feeding direction. The print sheet is thus either folded crosswise or lengthwise.

According to another embodiment of the inventive apparatus, at least one second guide element for the print sheet is embodied and arranged between the at least one, first guide element and the compressed air device and extends up to the region of the exit openings in the segments. A defined guidance of the two trailing ends of a print sheet to be conveyed into the folding gap is thus also possible.

According to a different embodiment of the inventive apparatus, at least a first and a second folding position are arranged, spaced apart and one behind the other in the guide plane in the second feeding direction. Arranged downstream of the folding rollers are at least two removal sections for the print sheets. The first removal section in this case is embodied to accommodate at least one print sheet, provided in the first folding position, while the second removal section is embodied to accommodate at least one print sheet made available in the second folding position. The print sheet according to a different embodiment of the inventive method is accordingly made available in one of at least two folding positions, arranged successively in the second feeding direction. The respective folding position is selected based on a specified production order, and the blast of compressed air is blown only onto the print sheet that is made available in the folding position. Following the folding operation, the print sheet is then accommodated in one of at least two removal sections.

According to a different embodiment of the inventive method, at least two successively following print sheets are made available in the respectively other of two folding positions and, following the folding operation, are accommodated in the respectively other of the at least two removal sections. Owing to the embodiment with at least two folding positions and at least two removal sections that operate jointly with the folding positions and because the segments are admitted with the aid of the compressed air device, a following print sheet can advantageously be transported into the apparatus before a preceding print sheet has reached its folding position. As a result, a clear increase in the capacity of the method according to the invention is possible. In addition, with this solution the print sheets can be separated particularly easily into at least two product flows, thus making it possible to omit a corresponding diverter function of an upstream-arranged or downstream-arranged device. Print sheets which do not meet quality requirements can thus be conveyed away with the aid of the second folding position and therewith cooperating removal while, parallel thereto, the production continues via the first folding position and therewith cooperating removal section.

According to a different embodiment of the inventive apparatus, at least a first and a second folding position are embodied in the guide plane, one behind the other and arranged overlapping in the second feeding direction. A joint removal section is arranged downstream of the folding rollers, which is embodied such that it can accommodate at least one print sheet provided in the first folding position and at least one print sheet provided in the second folding position, such that these are positioned overlapping in the second feeding direction. During the operation of said apparatus, at least two successively following print sheets are made available overlapping in respectively the other of at least two folding positions, arranged one behind the other in the second feeding direction. For this, the respective folding position is selected based on a specified production order. The compressed air blast in each case is directed only toward the print sheet located in the folding position. Following the folding operation, the print sheets are accommodated overlapping in a joint removal section. At least two overlapping product flows of folded print sheets can thus advantageously be conveyed jointly and can be processed further either jointly or separately. A different embodiment of the inventive apparatus comprises at least one first and at least one second end stop, respectively arranged in the guide plane, wherein the second end stop is arranged in the second feeding direction, upstream of the first end stop. Both end stops are embodied so as to be lifted up above the guide plane and/or lowered below the guide plane. These optional end stops function to support the print sheets located in the respective folding position.

According to a different embodiment of the apparatus according to the invention, the compressed air device is provided with an orientation plane, extending parallel to and at a distance to the guide plane, and is arranged displaceable and/or pivoting in this orientation plane. As a result, the compressed air device can be displaced parallel to the guide plane and/or can be pivoted and a print sheet that is supplied and/or positioned twisted can still be conveyed optimally to the folding rollers following a correspondingly directed blast of compressed air from the exit openings.

According to yet another embodiment of the method according to the invention, at least a second blast of compressed air follows the first blast, wherein the pressure and/or the time interval for the second blast of compressed air are preferably selected to differ from the first blast of compressed air. The folding quality of the print sheet can thus be improved further. In particular with print sheets having an asymmetric geometry, meaning print sheets with uneven page numbers, it is thus possible to avoid the development of dog ears on the trailing sections of the folded print sheet by administering at least one such additional blast of compressed air.

According to a different embodiment of the inventive method, the compressed air blast directed onto an available print sheet is suppressed and this print sheet is removed from the guide plane. Print sheets which do not meet quality requirements can thus be advantageously removed without the use of an additional device, meaning this operation can be realized easily and cost-effectively.

According to yet another embodiment of the inventive apparatus, the at least one control element of at least one segment of the compressed air device can be activated via the control unit so that a time interval is changed during which at least one exit opening of this segment is admitted with compressed air, and/or the cross sectional surface of the exit opening and/or a pressure of the compressed air supplied to the exit opening are adapted to the properties of the available print sheet.

For this, the time interval is changed during which the at least one exit opening of at least one segment of the compressed air device is admitted with compressed air, and/or the cross-sectional surface of this exit opening is changed, and/or the pressure of the compressed air supplied to this exit opening is changed with the aid of the control unit. The control unit then triggers a modified blast of compressed air corresponding to the properties of the available print sheet.

According to a different embodiment of the inventive apparatus, the segments of the compressed air device advantageously comprise at least one first control element for changing the time interval for admitting the at least one exit opening with compressed air, and/or at least one second control element for changing the cross-sectional surface of this exit opening, and/or at least one third control element for changing a pressure of the compressed air which can be supplied to this exit opening.

At least one segment of the compressed air device for a different embodiment of the inventive apparatus is provided with at least two first exit openings with identically large cross-sectional surfaces and at least two second exit openings with identically large cross-sectional surfaces, wherein the cross-sectional surfaces of the first exit openings preferably differ in size from the cross-sectional surfaces of the second exit openings. These segments furthermore comprise at least one control element and at least one other control element for changing the time interval during which the exit openings are admitted with compressed air and for changing the cross-sectional surfaces of the exit openings, wherein the first exit openings are connected to the one control element and the second exit openings are connected to the other control element. In addition to these control elements, the segment is provided with at least one further control element that is connected to the exit openings and is used to change a pressure of the compressed air that can be supplied to the exit openings.

The time interval for admitting the first and the second exit openings with compressed air and for changing the cross-sectional surfaces of these exit openings may be changed by admitting the first exit openings with the aid of the one control element and the second exit openings with the aid of another control element, so as to match the properties of the available print sheet to be folded. In addition, a pressure of the compressed air that is supplied to the exit openings can optionally be changed with the aid of the at least one additional control element that is connected to the exit openings.

With this apparatus and/or with the corresponding method, the cross-sectional surfaces of the exit openings in the compressed air device, as well as the time intervals for admitting these exit openings with compressed air, can be changed particularly easily, quickly and precisely, thereby making it possible to further improve the folding quality as well as the folding capacity in a cost-effective manner.

BRIEF DESCRIPTION OF THE DRAWINGS

These and other features and advantages of the invention will be further understood from the following detailed description of embodiments of the invention with reference to the drawings, which show in.

DETAILED DESCRIPTION

Figure 1:
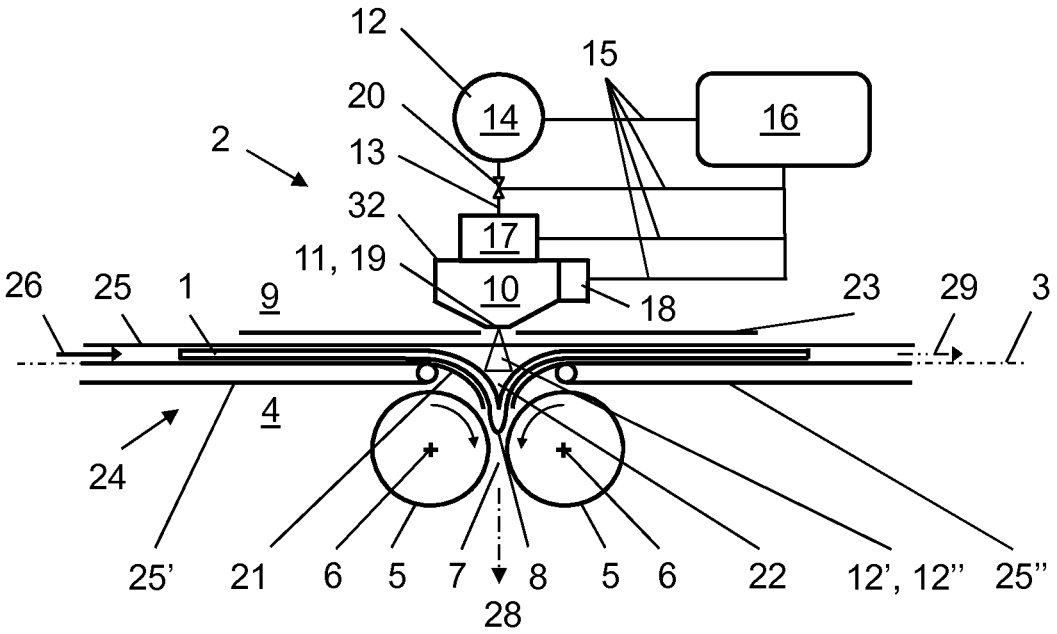
FIG. 1 A schematic view from the front of a first embodiment of the inventive apparatus for print sheets to be folded crosswise to the feeding direction.

According to the first exemplary embodiment shown in FIG. 1, an apparatus 2 according to the invention, which is designed for the cross folding of a print sheet 1, comprising respectively at least two printed pages, is provided with a guide plane 3 in which respectively one print sheet 1 to be folded is supplied and from which the print sheet 1 can be conveyed further to the folding position. The guide plane 3 is shown extending horizontally herein, but can also extend in vertical direction or be arranged at any optional angle in space which makes possible a plurality of design options, depending on the specific conditions for use. Even though only a single print sheet 1 is described herein and also in the following text for reasons of simplicity and only a single print sheet 1 is shown, at least one print sheet 1 is referred to each time, meaning it can relate to a single sheet 1 or several sheets stacked one above the other.

Two folding rollers 5 are arranged on a first side 4 of the guide plane 3 which, for drawing reasons, is shown in the first embodiment below the guide plane 3. The individual rollers are provided with a separate rotational axis 6 and form a folding gap 7 between them for folding the print sheet 1 along a predetermined or also not predetermined folding line 8. The rotational axes 6 of the folding rollers 5 are oriented parallel to each other as well as parallel to the guide plane 3. On a second side 9 which is shown above the guide plane 3 for the example in FIG. 1 and is located opposite the first side 4 of the guide plane 3, a compressed air device 10 is arranged in the region of the folding gap 7. The compressed air device 10 of the apparatus 2 has a segmented design. It comprises at least two, preferably more than two, segments 32 which are arranged side-by-side in a first feeding direction 26, extending essentially at a right angle to the rotational axes 6 of the folding rollers 5. Each segment 32 is provided with at least one, preferably several exit openings 11 for the compressed air 12, which are directed toward the folding gap 7, and is connected via a compressed air line 13 to a compressed air source 14 which, in turn, is connected via a control line 15 to a control unit 16 of the apparatus 2. Each segment 32 furthermore comprises a first control element 17, e.g. embodied as a magnetic valve, for changing the time interval during which the at least one exit opening 11 is admitted with compressed air 12, as well as a second control element 18, e.g. embodied herein as a slider, for changing a cross-sectional surface 19 of this exit opening 11, and a third control element 20 that is arranged in the compressed air line 13 and is embodied, for example, as pressure-reducing valve for changing the pressure of the compressed air 12 which can be supplied to this exit opening 11. The control elements 17, 18 and 20 are connected via separate control lines 15 to the control unit 16.

Arranged essentially in the guide plane 3 of the apparatus 2 is a first guide element 21 for the print sheet 1 on which the available print sheet rests and which is provided in the region of the folding gap 7 with an opening 22 for the print sheet 1 and for the compressed air 12 blown out of the exit openings 11, respectively in the form of a blast of compressed air 12'. In addition to the first guide element 21, a second guide element 23 is provided for the print sheet 1, which is arranged between the first guide element 21 and the compressed air device 10 and, if applicable, can operate jointly with the first guide element 21.

A guide table can be used, for example, as the first guide element 21. Of course, several small and spaced-apart guide elements can also be arranged side-by-side and/or one behind the other instead of a single guide table. As shown in FIG. 1, the first guide element 21 can be extended in the region of its opening 22 from the guide plane 3 to near the region of the folding rollers 5, so as to ensure a better guidance of the print sheet 1 toward the folding rollers 5, wherein a stationary element can also be used for the second guide element 23, such as a sheet-metal guide. The second guide element 23 extends up to the immediate region of the exit openings 11 in the segments 32, so that the two trailing ends of the print sheet 1 which is conveyed into the folding gap 7 between the folding rollers 5, can advantageously also be subjected to a defined guidance by the second guide element 23. Of course, the second guide element 23 can also consist of several small individual elements which are arranged spaced-apart, either side-by-side and/or one behind the other. In the same way as the guide plane 3 of the apparatus 2, the first and the second guide elements 21, 23 can also be arranged horizontally, vertically or at any optional angle in space, depending on the specific use requirements.

The apparatus 2 finally also comprises a transport unit 24, consisting of an upper transport belt 25 and two circulating lower transport belts 25', 25" which are intended to supply the print sheets 1 in a first feeding direction 26 that extends substantially at a right angle to the rotational axes 6 of the folding rollers 5. The apparatus 2 can thus be used for the cross-folding of print sheets 1.

Figure 2:
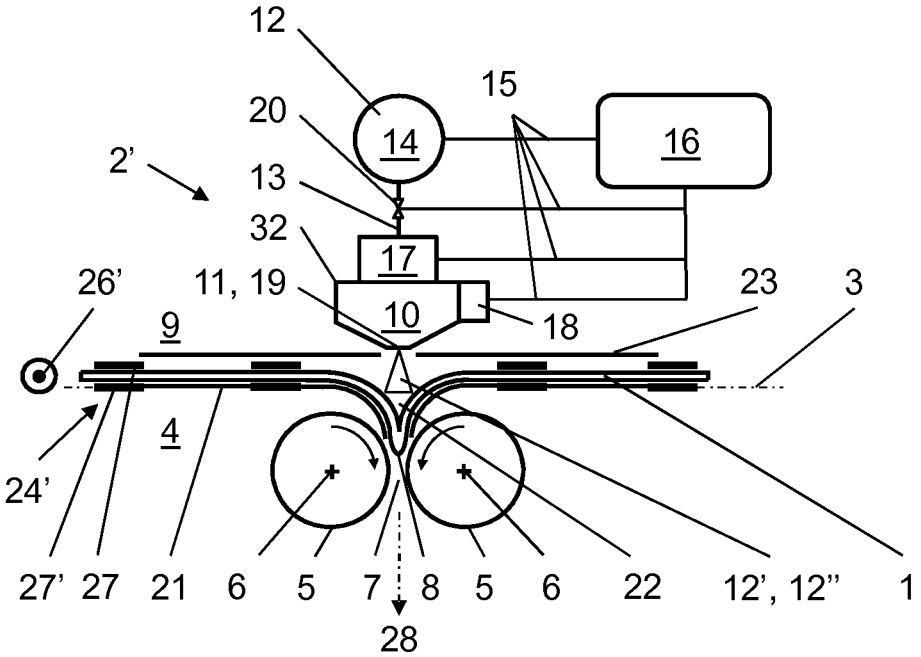
FIG. 2 A schematic view from the front of a second exemplary embodiment of the inventive apparatus, for print sheets to be folded in a longitudinal direction.

Corresponding to a second exemplary embodiment, illustrated in FIG. 2, an inventive apparatus 2', designed for the longitudinal folding of print sheets 1 that contain respectively at least two printed pages, is provided with a second feeding device 26' for the print sheet 1 which extends parallel to the rotational axes 6 of the folding rollers 5 and, accordingly, also comprises a second transporting unit 24' that extends parallel to the rotational axes 6 of the folding rollers 5 and is provided with upper and lower transport belts 27, 27'. The remaining components of the apparatus 2' for the most part correspond to those described for the apparatus 2 of the first exemplary embodiment, wherein the segments 32 of the compressed air device 10 are arranged one behind the other in the second feeding direction 26' for the print sheet 1.

During the operation of the apparatuses 2, 2', shown in FIGS. 1 and 2, the control unit 16 respectively transmits a pulse to the segments 32 of the compressed air device 10, for triggering a blast of compressed air 12' that is directed via the at least one exit opening 11 onto the folding line 8 of the respective print sheet 1. With the aid of the control unit 16, the time interval is changed during which the at least one exit opening 11 of the segments 32 is admitted with compressed air 12, and/or a cross-sectional surface 19 of this exit opening 11 is changed, and/or the pressure of the compressed air 12 supplied to this exit opening 11 is changed, so as to adapt to the properties of the supplied print sheet 1. The properties of the supplied print sheets 1 are known ahead of time to the control unit 16 which activates the first control element 17 and/or the second control element 18 and/or the third control element 20 if a change occurs in the properties of the print sheet 1 to be folded. In the process, the time interval during which the at least one exit opening 11 of the segments 32 is admitted with compressed air 12 is changed by activating the first control element 17. The cross-sectional surface 19 of this exit opening 11 is respectively changed by activating the second control element 18. The pressure of the compressed air 12 that can be supplied to this exit opening 11 is changed by activating the third control element 20.

The blast of compressed air 12' can thus be triggered corresponding to the feeding speed of a print sheet 1, which is respectively known to the control unit 16, wherein the time until the compressed air 12 hits the folding line 8 of the print sheet 1 must be factored in. Of course, the compressed air blast 12' can also be triggered based on an actual position of the print sheet 1, e.g. detected with a sensor that is not shown. The instant of triggering the compressed air blast 12' can furthermore also be varied. Successive print sheets 1 can thus be made available in different folding positions, so that the folded print sheets 1 overlap each other in the first or in the second feeding direction 26, 26' and, if necessary, can be separated again for the further processing at the locations where they overlap.

Under the effect of the administered compressed air blast 12', the print sheet 1 is guided along its folding line 8 into the folding gap 7 between the folding rollers 5 where it is folded in cross direction (FIG. 1) or in longitudinal direction (FIG. 2). The folding rollers 5 subsequently transport the folded print sheet 1 to a removal section 28, which is not shown in further detail herein.

A sensor, not shown herein, can be arranged downstream of the folding rollers 5 to detect dog ears, incorrectly folded areas and the like, wherein this sensor can transmit corresponding signals to the connected control unit 16. Following an automatic evaluation of this information, the segments 32 of the compressed air device 10 and/or the respective blast of compressed air 12' can be activated accordingly to avoid future quality deficiencies of this type. The compressed air device 10 and thus also the complete apparatus 2, 2' are consequently embodied self-teaching.

If a print sheet 1 which does not meet quality requirements is made available in the apparatus 2, 2' and this is detected, for example with a non-depicted sensor, the control unit 16 can suppress the pulse for triggering a compressed air blast 12', so that this print sheet 1 is transported further to a removal section 29 (FIG. 1), not shown in further detail herein, with the aid of the respective transport unit 24, 24' in the guide plane 3 and can be removed from the apparatus 2, 2'. A corresponding diverter function of an upstream-arranged or a downstream-arranged device can thus advantageously be omitted.

Figure 3:
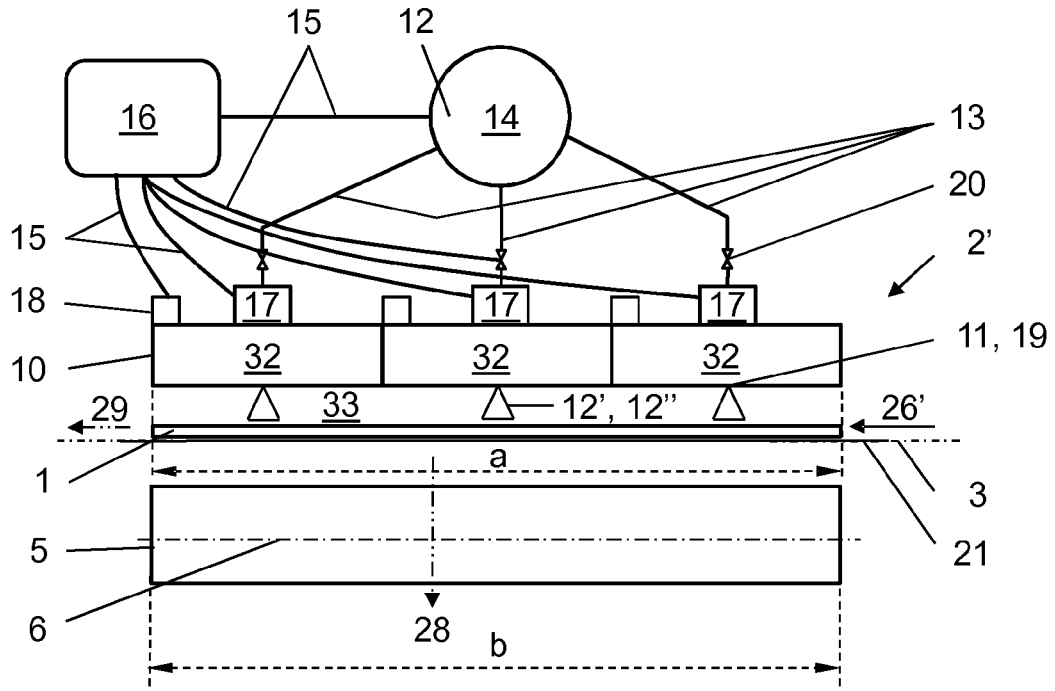
FIG. 3 A schematic view, seen from the side, of a portion of an apparatus similar to FIG. 2, but showing a different exemplary embodiment with three segments for the compressed air device and with a folding position for the print sheets.
Figure 4:
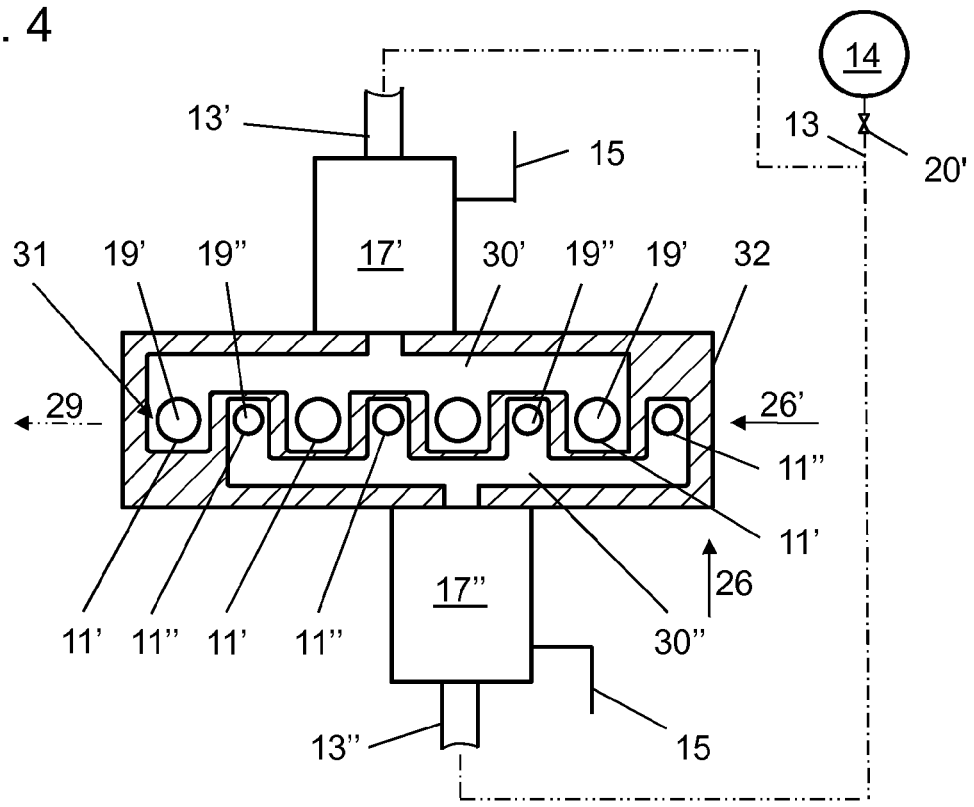
FIG. 4 An enlarged schematic representation of a section through one of the segments of the compressed air device, shown in FIG. 3, revealing several exit openings arranged in a row.

According to the additional exemplary embodiment of the apparatus 2', shown in FIG. 3, the compressed air device 10 and the folding rollers 5 are essentially embodied to have the same longitudinal extension a, b which, of course, can also be embodied differently. The segmented compressed air device 10 of the apparatus 2' comprises three segments 32 which are arranged one behind the other in the second feeding direction 26' of the apparatus 2'. Of course, compressed air devices 10 having only two or more than three segments 32 can also be used. Each segment 32 of the compressed air device 10 is embodied to be activated separately with compressed air 12 and comprises an exit opening 11 for the compressed air 12. Of course, each segment 32 can also be provided with several exit openings 11 which are arranged in at least one row 31 (FIG. 4).

A shown in FIG. 3, the segments 32 are connected, for example, to the compressed air source 14 by means of a separate first control element 17, also embodied as a magnetic valve, as well as respectively one compressed air line 13. In addition, the segments 32 also comprise respectively a second control element 18, e.g. embodied as a slider, and respectively a third control element 20 that is embodied as a pressure-relief valve. For reasons of clarity, all control lines 15 from the control unit 16 to the first control elements 17 and/or to the compressed air source 14 are shown, whereas only one control line 15 leading to the second and to the third control elements 18, 20 is respectively shown in the exemplary embodiment. Of course, a single compressed air line 13 for all segments 32 can also be used instead of a separate compressed air line 13 for each segment 32, or the segments 32 can be combined into groups and several segments 32 can be supplied via a joint compressed air line 13. In that case, correspondingly arranged control elements, not shown herein, ensure that the segments 32 and/or their exit openings 11 are admitted with compressed air 12.

The exit openings 11 of the segments 32 each have a cross-sectional surface 19, wherein the size of the cross-sectional surfaces 19 can be changed, for example through using correspondingly adjustable apertures, not shown herein, which are controlled by the second control element 18. The shape of the cross-sectional surfaces 19 is freely selectable, meaning the cross-sectional surfaces 19 can have a circular, semi-circular or elliptical shape, but can also have a rectangular, triangular or gap-type shape. As an alternative to changing the size of the cross-sectional surfaces 19, the pressure of the compressed air 12 supplied to the exit openings 11 can also be varied by correspondingly triggering the third control element 20 with the aid of the control unit 16. Finally, the time interval for admitting the segments 32, and thus also the exit openings 11, with the compressed air 12 can alternatively or additionally also be changed.

To generate a longitudinal fold in a print sheet 1 with the aid of the apparatus 2', shown in FIG. 3, the respective print sheet 1 is supplied in a clocked operation in the second feeding direction 26' while positioned in the center and parallel to the rotational axes 6 of the folding roller 5, thus also parallel to the compressed air device 10, and is made available in a folding position 33 for the folding operation. Accordingly, the control unit 16 triggers via the control lines 15 that are connected to the first control element 17 a blast of compressed air 12', which is emitted through the exit openings 11 of the segments 32 of the compressed air device 10, as soon as the respective print sheet 1 has reached the folding position 33. In dependence on the properties of the print sheet 1 which are known to the control unit 16, such as the format, the grammage, and the speed, the control unit 16 determines the pressure required for generating the compressed air blast 12' and, if applicable, correspondingly adjusts or re-adjusts this compressed air blast with the aid of the third control element 20. In addition or alternatively thereto, the cross-sectional surfaces 19 of the exit openings 11 can also be adjusted via the control unit 16 and the second control element 18, and/or the time interval for admitting the individual segments 32 and thus the duration of the compressed air blast 12' can be adjusted via the first control elements 17. The average duration of a compressed air blast 12' is approximately 5 to 10 milliseconds (ms) while the pressure used is in the range of approximately 300 to 800 kPA (3 to 8 Bar). Owing to the power exerted by the compressed air blast 12', the print sheet 1 which for the most part is multi-layered is transported out of the guide plane 3 to the rotating folding rollers 5, meaning the sheet is pressed nearly planar against the folding rollers 5. In the process, the print sheet 1 is pulled first in the region of the folding line 8, leading because of the impact of the compressed air 12, and finally completely between the folding rollers 5, meaning into the folding gap 7, is then pressed along the folding line 8 and is subsequently transported further in downward direction to the removal section 28, which is not shown in further detail herein.

Owing to the fact that the cross-sectional surfaces 19 can be changed and owing to the additionally or alternatively supplied compressed air 12, supplied with a different pressure and/or time duration to the exit openings 11, the apparatus 2' can be adjusted or re-adjusted relatively easily and quickly to match the properties of the respective print sheet 1, as well as to adapt it to the requirements of a current production order.

In a schematic representation that is essentially identical to the one shown in FIG. 3, FIG. 4 shows a sectional view through a segment 32 of the compressed air device 10. The segment 32 of this additional variant comprises two separate compressed air lines 13',13" which are connected to the compressed air source 14, and are provided with control elements 17', 17" also embodied as magnetic valves, designed for changing the time interval during which the exit openings 11', 11" are admitted with compressed air 12, as well as to change the cross-sectional surfaces 19', 19" of the exit openings 11', 11". The segment 32 furthermore comprises respectively one distribution line 30', 30" that is connected to the compressed air lines 13', 13" and is arranged on the inside of the segment 32, for respectively four first and/or four second exit openings 11', 11", wherein the first exit openings 11' are connected to the one control element 17' and the second exit openings 11" are connected to the other control element 17". Of course, it is also possible to have two, three, or more exit openings which are connected to the distribution line 30' and/or the distribution line 30" in place of the respectively four exit openings 11', 11", shown herein. The cross-sectional surfaces 19', 19" of the exit openings 11', 11" belonging to the same distribution line 30', 30" are embodied identically in size, wherein the size differs from the size of the four exit openings 11", 11' belonging to the respectively other distribution line 30', 30", such that the four first exit openings 11' are each embodied with a larger cross-sectional surface 19' and the four second exit openings 11" are embodied with a smaller cross-sectional surface 19".

This variant permits a relatively simple metering out of the blast of compressed air 12' coming from the segment 32. The pressure of the compressed air 12 in the segment 32 is high, for example, if both control elements 17', 17" are opened, meaning it results in a relatively strong compressed air blast 12'. On the other hand, if the two control elements 17', 17" are closed then the segment 32 is inactive. A weak blast of compressed air 12 results if only the control element 17" is opened which is connected to the exit openings 11" having a small cross-sectional surface 19'. A medium-strong compressed air blast 12' is generated by opening only the control element 17' that is connected to the exit openings 11' which have a larger cross-sectional surface 19'. By opening or closing the two control elements 17', 17", the time interval during which the segment 32 is admitted with compressed air 12 is additionally changed. The compressed air 12 can furthermore be supplied with different pressures to the exit openings 11', 11" of the segment 32 by correspondingly triggering via the non-depicted control unit 16 an additional control element 20', e.g. embodied as pressure-relief valve and arranged in the compressed air line 13 leading to the compressed air source 14. The dash-dot lines in FIG. 4 indicate that the two compressed air lines 13', 13" are combined in this case to form the compressed air line 13.

During the operation of the apparatus 2', several exit openings 11', 11" of a segment 32 which are respectively connected to the same control element 17', 17" are thus activated simultaneously with compressed air 12. By correspondingly triggering the control elements 17', 17" 20', the blast of compressed air 12' from a single segment 32, from several segments, or from all segments 32 can thus be metered out easily and quickly, in accordance with the properties of the print sheet 1 that is made available in the folding position 33.

Of course, the cross-sectional surfaces 19', 19" of the first and the second exit openings 11', 11" in the segment 32 of the compressed air device 10 can also be embodied identically. However, this results in only a slight gradation of the metered out compressed air blast 12', as compared to the use of the previously described, differently large cross-sectional surfaces 19', 19". In the same way, the cross-sectional surfaces 19, 19', 19" of the exit openings 11, 11', 11" in different segments 32 can be embodied to be different in size and/or the compressed air 12 to the exit openings 11, 11', 11" of different segments 32 can be supplied with compressed air having different pressures, and/or the time interval during which the different segments 32 are admitted with compressed air 12 can be selected to be different.

Identical or differently strong blasts of compressed air 12' can advantageously be triggered by the segments 32, using at least one of these measures. As a result, the folding process can be adapted optimally to the aforementioned properties of a print sheet 1 ready for folding, such as grammage, format, frictional value, porosity, color assignment and the like, thus making it possible to achieve a constant and good folding quality. By using at least one of these measures, a deviation from the folding position 33 of the print sheet ready for folding can furthermore be corrected at least in part. During the cross-folding, asymmetrically folded print sheets 1, for example having different page numbers distributed over the print sheet 1, can be admitted with different blasts of compressed air 12'. That is to say, locations with smaller sheet thickness are admitted with compressed air blasts 12' from the at least one exit opening 11" with a smaller cross-sectional surface 19", and/or blasts with a lower pressure, and/or blasts administered over a shorter time interval than locations having a larger sheet thickness.

Figure 6:
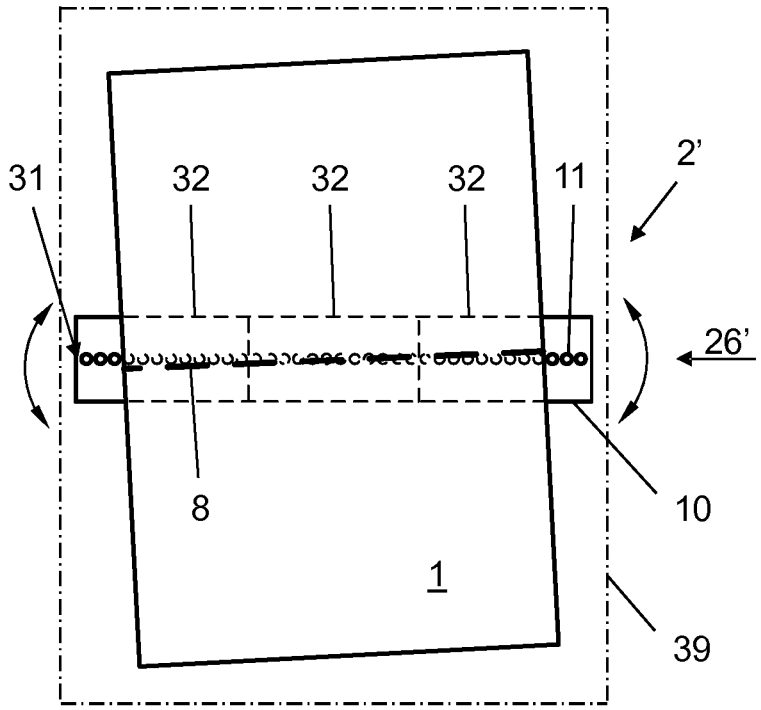
FIG. 6 A view from below of the compressed air device according to FIG. 3, with exit openings that are arranged in a single row and a print sheet to be folded that has been supplied in a twisted position.

As shown in FIGS. 4 and 6, the exit openings 11, 11', 11" of the segments 32 of the compressed air device 10 are arranged in a row 31, formed in a plane that is not shown herein and which extends essentially perpendicular through the guide plane 3. As a result, a print sheet 1 that is supplied in the correct position to the apparatus 2, 2', in the first or second feeding direction 26, 26', can thus be conveyed with the aid of the generated blast of compressed air 12' precisely and securely to the folding rollers 5 and can be folded therein with high quality.

Figure 5A:
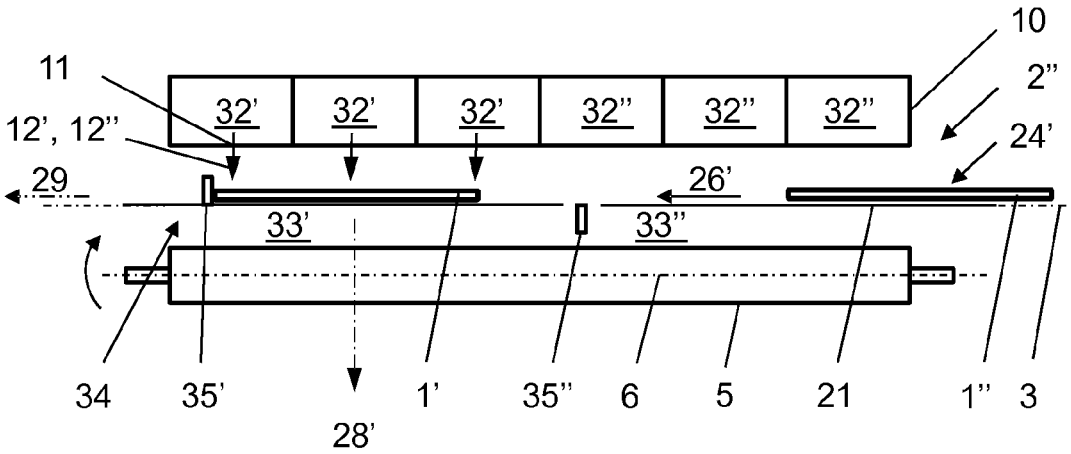
FIG. 5*a* A schematic view from the side, showing portions of a similar apparatus as the one shown in FIG. 3, but showing an additional exemplary embodiment provided with six segments for the compressed air device and two spaced-apart folding positions for the print sheets during a first method step.
Figure 5B:
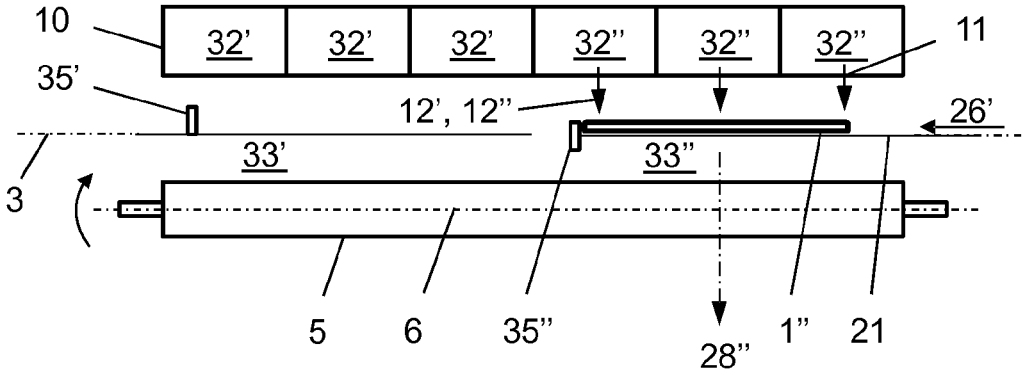
FIG. 5*b* A view corresponding to FIG. 5*a*, but showing a second method step.

The additional exemplary embodiment shown in FIGS. 5*a* and 5*b* represents a schematic view from the side of an apparatus 2" for the longitudinal folding of print sheets 1', 1", wherein the control elements previously shown in FIGS. 1 to 4 have been omitted for reasons of clarity. The compressed air device 10 for this apparatus 2" is provided with three downstream arranged segments 32', as well as with three upstream arranged segments 32", and comprises two folding positions 33', 33", arranged successively in feeding direction 26' in which the print sheets 1', 1" are supplied with the second transporting unit 24', only indicated herein, and made available on the first guide element 21. To support a print sheet 1' that is made available in the first folding position 33', the apparatus 2" is provided with a first end stop 35', arranged in the guide plane 3 at the downstream end 34 of the apparatus 2". To support a print sheet 1" that is made available in the second folding position 33", at least one additional end stop 35" is arranged upstream of the at least one first end stop 35' and is positioned at a distance to the first end stop 35' which exceeds the format. Both end stops 35' and 35" are embodied such that they can be lifted up above the guide plane 3 and/or lowered below the guide plane 3. As compared to the apparatuses 2, 2' shown in FIGS. 1 and 2, the apparatus 2" comprises two removal sections 28', 28" for folded print sheets 1', 1". Analogous to the apparatus 2', a first print sheet 1' is supplied in a clocked operation in the second feeding direction 26', centered and parallel to the rotational axes 6 of the folding rollers 5, meaning the print sheet is made available for the folding. However, the sheet here is made available only in one of at least two folding positions 33', 33", provided successively in feeding direction 26'. The respective folding position 33', 33" is selected based on a specified production order and the blast of compressed air 12' is respectively directed only toward the print sheets 1', 1" located in the folding position 33', 33'. Accordingly, the control unit 16 triggers a compressed air blast 12' via the first control element 17 which is emitted through the exit openings 11 of the segments 32' of the compressed air device 10 as soon as the print sheet 1' has reached the desired folding position 33'. In the same way as for the apparatuses 2, 2', a print sheet 1', 1" that does not meet quality requirements can be conveyed further with the transport unit 24' in the guide plane 3 to the removal section 29 and can thus be removed from the apparatus 2". The first end stop 35' is thus either raised above the guide plane 3 or lowered below the guide plane. A corresponding diverter function of an upstream-arranged or downstream-arranged device can therefore be omitted with this exemplary embodiment as well.

In FIG. 5*a*, the apparatus 2" is shown during a first method step in which initially the first print sheet 1', supplied in the guide plane 3, has arrived at the first end stop 35' and is available in the first folding position 33'. At that point in time, the following second print sheet 1" has already entered at least partially the apparatus 2". In order to trigger a compressed air blast 12' and thus supply the first print sheet 1' to the folding rollers 5, only the three downstream segments 32' of the compressed air device 10, as seen in feeding direction 26', are admitted with compressed air 12 by correspondingly activating the first control elements 17, while the three upstream arranged segments 32" are deactivated. The folded first print sheet 1' is subsequently transported further with the aid of the folding rollers 5 to the first removal section 28'.

As a result of embodying the apparatus 2 with two folding positions 33', 33" and two removal sections 28', 28", as well as owing to the segment-by-segment admitting with compressed air from the compressed air device 10, the following print sheet 1" can advantageously already be conveyed into the apparatus 2" while the preceding print sheet 1' has not yet reached its folding position 33'.

The following print sheet 1" can then either be conveyed to the same folding position 33' at the first end stop 35' or, as shown in FIG. 5*b* for the second method step, can be made available in the second folding position 33" which is located further upstream, once the second end stop 35" has been raised up into the guide plane 3 of the apparatus 2". By correspondingly activating only the upstream-arranged segments 32" of the compressed air device 10, this print sheet 1" is subsequently also conveyed to the folding rollers 5, is folded there, and is then transferred to the second removal section 28". By dividing the print sheets 1 into two separate production flows, to be folded separately and conveyed to the separate removal sections 28', 28", the print sheets 1', 1" in the apparatus 2" can already be separated into print sheets 1', 1" belonging to the same book block to be formed later on. Based on the current production order, the apparatus 2" can thus be operated with the aid of the control unit 16 in such a way that the print sheets 1', 1" are respectively made available alternately in one of the two folding positions 33', 33" and are thus supplied to the corresponding removal section 28', 28". In addition to the previously described removal of non-folded print sheets 1', 1" with the aid of the removal section 29, it is also possible to remove folded print sheets 1', 1" that do not meet quality requirements with the aid of one of the removal sections 28', 28" while the production continues with the aid of the other removal section 28", 28'.

Figure 5C:
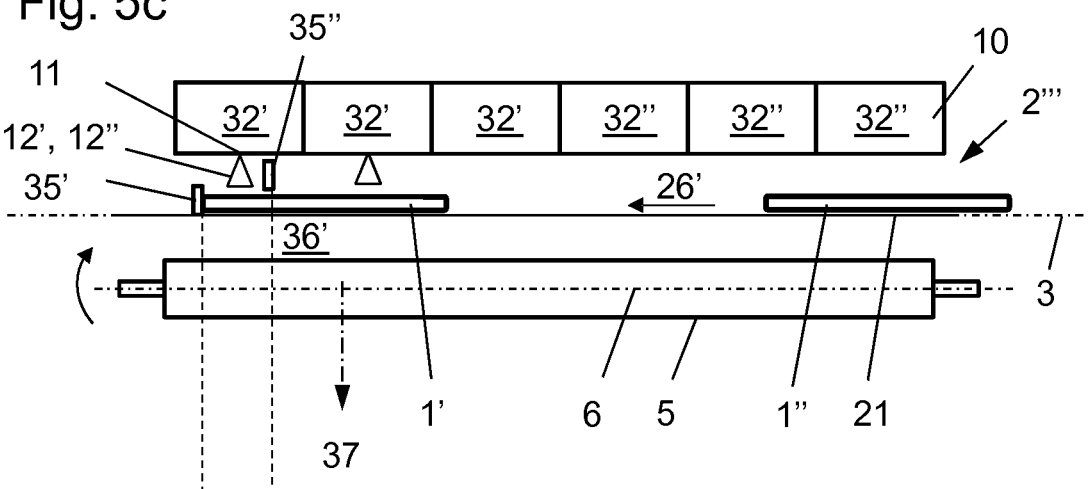
FIG. 5*c* A view corresponding to FIG. 5*a*, but showing a different exemplary embodiment with two overlapping folding positions for the print sheets.
Figure 5D:
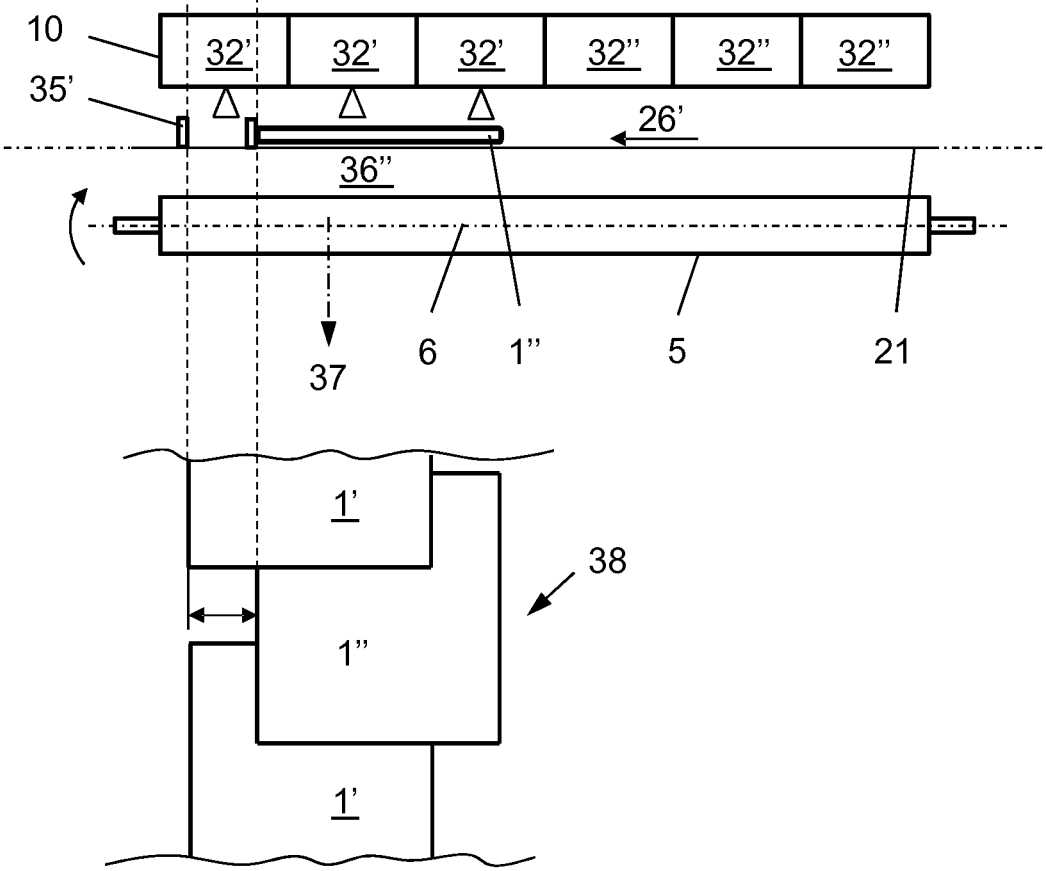
FIG. 5*d* A view corresponding to FIG. 5*c*, but showing a second method step and additionally showing printed products, arranged overlapping, which are conveyed away in a first feeding direction.

FIGS. 5*c* and 5*d* show another and similar exemplary embodiment, comprising an apparatus 2', embodied with two overlapping folding positions 36', 36" in the second feeding direction 26' and a joint removal section 37 for the overlapping print sheets 1', 1" instead of the spaced apart folding positions 33', 33" shown in FIGS. 5*a* and 5*b*. The two end stops 35', 35" are thus arranged spaced apart by a measure that is below the format dimensions. Depending on the further processing, a product flow 38 of folded print sheets 1', 1" which partially overlap in the second feeding direction 26' can thus be generated in the joint removal section 37, wherein these print sheets later on form a joint book block or can also be separated again. Of course, a non-depicted second product flow of print sheets 1', 1" that partially overlap in the second feeding direction 26' can also be generated with this apparatus 2" by repeatedly supplying successive print sheets 1' in the first folding position 36' and/or by repeatedly and successively supplying print sheets 1" in the second folding position 36". With this second product flow, several successively following print sheets 1' and/or several successively following print sheets 1" can furthermore partially overlap crosswise to the second feeding direction 26'.

With the exemplary embodiments shown in FIGS. 5*a* and 5*b*, as well as in FIGS. 5*c* and 5*d*, the compressed air blast 12' can also be triggered prior to reaching the respective folding position 33, 33', 33", 36', 36", so as to reinforce the print sheet 1', 1" with a deformation thus occurring crosswise to the feeding direction 26', such that the danger of a deformation in feeding direction 26', resulting from the impacting of the print sheet 1', 1" with the end stops 35',35", can be excluded.

With a corresponding design for the second transport unit 24', for example comprising upper and lower transport belts 25, 25', 25", the apparatus 2" (FIGS. 5*a* and 5*b*) as well as the apparatus 2' (FIGS. 5*c* and 5*d*) can, of course, also be operated without the end stops 35', 35". In that case, the print sheets 1', 1" are supplied exclusively with the aid of the second transport unit 24' and the guide elements 21, 23 to the respective folding position 33', 33", 36', 36". The end stops 35' and 35" can then optionally function to help make available the print sheets 1', 1".

As indicated by double arrows in FIG. 6, the compressed air device 10 that is also divided into three segments 32 is embodied, for example, so as to be displaceable with the aid of a motor and/or pivoting in an orientation plane 39 which extends parallel and at a distance to the guide plane 3, not shown herein, of the apparatus 2'. As a result, a print sheet 1 that is supplied while somewhat displaced or unaligned, relative to the apparatus 2', meaning the folding line 8 deviates from the row 31 of exit openings 11, can be admitted precisely with compressed air 12 along the folding line 8 and can thus be conveyed into the folding gap 7 between the folding rollers 5, which is not shown herein. The respective offset, meaning the absolute amount for the offset or misalignment of the print sheet 1 in the guide plane 3 is detected with sensors that are not shown herein and is transmitted further to the control unit 16. Following this, the control unit 16 activates a servomotor, also not shown herein, which displaces and/or pivots the compressed air device 10 in the orientation plane 39, thereby compensating for the offset of the print sheet 1.

Figure 7:
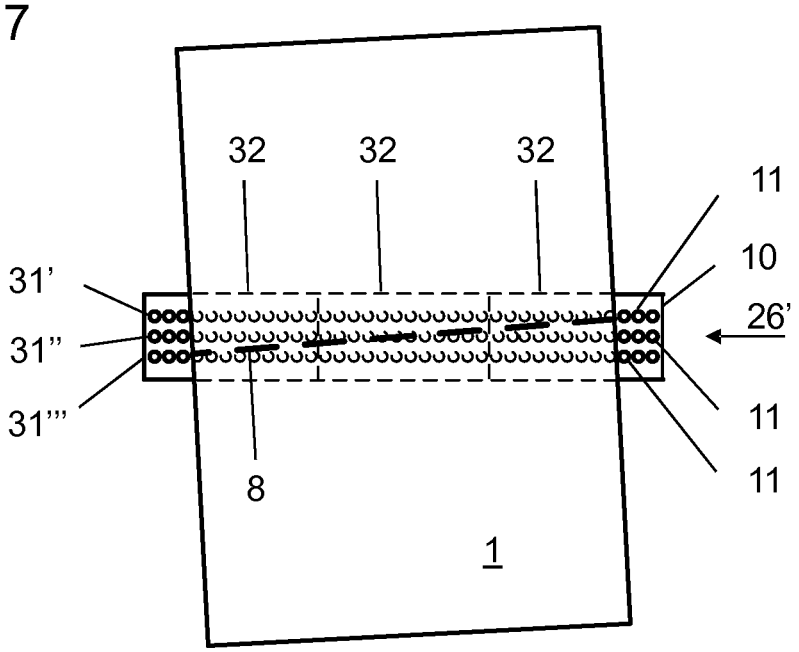
FIG. 7 A view of a different exemplary embodiment, functioning in a similar manner as the one according to FIG. 6, but with exit openings arranged in three rows on the compressed air device and a print sheet for folding, supplied in a twisted position.

Alternative to the solution presented in FIG. 6, FIG. 7 shows a different exemplary embodiment having a compressed air device 10 that is also provided with three segments 32, for which the exit openings 11 are arranged in three rows 31', 31" 31'" that extend parallel to the folding gap 7. In contrast to the exemplary embodiment shown in FIG. 6, if an offset of the print sheet 1 to be folded in the guide plane 3 is detected with the aid of sensors, not shown herein, the compressed air device 10 need not be displaced and/or pivoted in an orientation plane 39 for adapting the position of the exit openings 11. Rather, it is sufficient for correcting said offset to correspondingly trigger the exit openings 11 in the respective rows 31', 31", 31'", which are admitted segment-by-segment and parallel to the folding gap 7 with compressed air 12. For correcting the offset of the print sheet 1 that is shown in FIG. 7, for example, the exit openings 11 in the first row 31' of the upstream arranged segment 32, the exit openings 11 arranged in the second row 31" of the center segment 32, and the exit openings 11 in the third row 31'" of the downstream arranged segment 32 could be triggered with the aid of compressed air 12. To realize this solution, the exit openings 11 in the compressed air device 10 could, of course, also be arranged in two rows 31 or in more than three rows, which are respectively oriented parallel to the folding gap 7, and could also be arranged in more than three segments 32.

For all exemplary embodiments and to improve the folding quality, in particular to avoid dog ears in the folded print sheets 1, 1', 1" as a result of the compressed air blast 12', at least one second compressed air blast 12" can be directed toward the same print sheet 1 (see FIGS. 1 to 5*c*), for which the pressure and/or the time interval is preferably selected to be different as compared to the first compressed air blast. As a result, the folding quality of the print sheet can be improved further.

It will be understood that the above description of the present invention is susceptible to various modifications, changes and adaptations, and the same are intended to be comprehended within the meaning and range of equivalents of the appended claims.

What is claimed is:

1. An apparatus for folding of a print sheet, comprising:

at least one first guide element defining a guide plane in which the print sheet is made available;

at least two folding rollers, arranged on a first side of the guide plane and respectively provided with one rotational axis, the rotational axes being oriented parallel to each other and substantially parallel to the guide plane, wherein a folding gap is defined between the at least two folding rollers for the print sheet to be folded when the print sheet is in a folding position over the folding gap;

a compressed air source;

a control unit; and a compressed air device arranged in a region of the folding gap on a second side of the guide plane opposite the first side of the guide plane and essentially parallel to the rotational axes of the folding rollers, wherein the compressed air device includes at least two segments respectively connected with the compressed air source and the control unit, each segment has at least one exit opening with a cross-sectional surface for the compressed air focused onto the folding gap, each segment has at least one control element coupled to the control unit, and each segment is configured to be separately activated with compressed air;

wherein the at least one control element of each segment of the compressed air device comprises at least one of: at least one first control element for changing a time interval during which the at least one exit opening is admitted with compressed air, at least one second control element for changing the cross-sectional surface of the at least one exit opening, and at least one third control element for changing the pressure of the compressed air supplied to the at least one exit opening.

2. The apparatus according to claim 1, further including a transport device to move the print sheet in one of a first feeding direction that extends essentially at a right angle to the rotational axes of the folding rollers or a second feeding direction that extends essentially parallel to the rotational axes of the folding rollers, and the segments of the compressed air device are arranged side-by-side in the first feeding direction or one behind the other in the second feeding direction.

3. The apparatus according to claim 1, further comprising at least one second guide element for the print sheet arranged between the at least one first guide element and the compressed air device, wherein the second guide element extends just to a region of the exit openings of the segments.

4. The apparatus according to claim 2, wherein the folding position comprises one first and one second folding position successively arranged spaced apart in the second feeding direction; and further including at least first and second removal sections arranged downstream of the folding rollers, wherein the first removal section is configured to accommodate at least one print sheet in the first folding position and the second removal section is operative to accommodate at least one print sheet provided in the second folding position.

5. The apparatus according to claim 2, wherein the folding position includes at least one first and one second folding position arranged successively in the guide plane in the second feeding direction, and overlapping each other; and further including a joint removal section arranged downstream of the folding rollers and operative to accommodate overlapping in the feeding direction at least one print sheet provided in the first folding position and at least one print sheet provided in the second folding position.

6. The apparatus according to claim 1, further comprising at least one first and at least one second end stop arranged in the guide plane, wherein the second end stop is arranged in the second feeding direction, upstream of the first end stop, and each end stop is at least one of liftable above the guide plane and lowerable below the guide plane.

7. The apparatus according to claim 1, wherein the compressed air device has an orientation plane, extending parallel and at a distance to the guide plane, and is arranged to be at least one of displaced and pivoted in the orientation plane.

8. The apparatus according to claim 1, wherein the at least one control element of at least one of the segments of the compressed air device is activatable by the control unit so that at least one of a time interval during which the at least one exit opening of the segment is admitted with compressed air, a cross-sectional surface of the at least one exit opening, and a pressure of the compressed air supplied to the at least one exit opening, is changeable to adapt to properties of the print sheet.

9. An apparatus for folding of a print sheet, comprising:

at least one first guide element defining a guide plane in which the print sheet is made available;

at least two folding rollers, arranged on a first side of the guide plane and respectively provided with one rotational axis, wherein a folding gap is defined between the at least two folding rollers for the print sheet to be folded when in the folding position and the rotational axes are oriented parallel to each other and substantially parallel to the guide plane;

a compressed air source;

a control unit; and a compressed air device arranged in a region of the folding gap on a second side of the guide plane opposite the first side of the guide plane and essentially parallel to the rotational axes of the folding rollers, wherein the compressed air device includes at least two segments respectively connected with the compressed air source and the control unit, each segment has at least one exit opening with a cross-sectional surface for the compressed air focused onto the folding gap, each segment has at least one control element coupled to the control unit, and each segment is configured to be separately activated with compressed air, wherein at least one segment of the compressed air device comprises:

at least two first exit openings with identical first cross-sectional surfaces and at least two second exit openings with identical second cross-sectional surfaces, wherein the first cross-sectional surfaces of the first exit openings differ in size from the second cross-sectional surfaces of the second exit openings;

at least one control element and at least one other control element for changing the time interval during which the exit openings are admitted with compressed air and for changing the cross-sectional surfaces of the exit openings, respectively, wherein the first exit openings are connected to the one control element and the second exit openings are connected to the other control element; and at least one additional control element connected to the exit openings for changing the pressure of the compressed air supplied to the exit openings.

10. A method for folding print sheets using the apparatus of claim 1, comprising:

making available a print sheet to the folding position;

admitting the print sheet in the region of the folding gap with a compressed air blast from the second side of the guide plane with the compressed air device and the control unit, wherein the admitting step includes triggering, with the control unit, at least one of the first, second and third control elements, so that the compressed air blast is modified by changing at least one of (a) the time interval during which the at least one exit opening of the at least one segment of the compressed air device is admitted with compressed air, (b) the cross-sectional surface of the exit opening, and (c) the pressure of the compressed air supplied to the exit opening, in dependence of properties of the available print sheet supplied to the folding position, wherein the print sheet is transported under the effect of the compressed air blast, triggered by the control unit out of the guide plane to the rotating folding rollers; and folding the print sheet on the first side of the guide plane between at least the two rotating folding rollers.

11. The method according to claim 10, including supplying the print sheet in one of (a) a first feeding direction, essentially extending at a right angle to the rotational axes of the folding rollers, wherein the admitting step includes admitting the compressed air blast in a crosswise direction to the first feeding direction, or (b) in a second feeding direction which extends essentially parallel to the rotational axes of the folding rollers, wherein the admitting step includes admitting the compressed air blast long the second feeding direction.

12. The method according to claim 11, wherein the method includes at least one of displacing the compressed air device parallel to the guide plane and pivoting the compressed air device to compensate for a print sheet that is supplied while displaced and/or twisted in the guide plane relative to the feeding direction.

13. The method according to claim 11, wherein the making available step includes making the print sheet available in one of at least two folding positions arranged one behind the other in the second feeding direction, the method further including selecting the respective folding position corresponding to a specified production order and directing the compressed air blast only toward the print sheet in the selected folding position, and accommodating the print sheet after the folding operation in one of at least two removal sections.

14. The method according to claim 11, wherein the making available step includes making at least two successively following, spaced apart print sheets available in respectively one of at least two folding positions, arranged successively and spaced-apart in the second feeding direction, and further including selecting the respective folding position based on a specified production order and directing the compressed air blast in each case only toward the print sheet available in the selected folding position and accommodating the print sheet after the folding operation in respectively one of at least two removal sections.

15. The method according to claim 11, wherein the making available step includes making at least two successively following print sheets available while positioned overlapping in respectively one of at least two folding positions arranged one behind the other in the second feeding direction, and further including selecting the respective folding position according to a specified production order and directing the compressed air blast only onto the print sheet in the folding position, and accommodating the print sheets after the folding operation overlapping in a joint removal section.

16. The method according to claim 10, wherein the admitting step includes directing at least a second blast of compressed air toward the same print sheet following the compressed air blast, wherein at least one of the pressure and time interval for the second compressed air blast are changed, relative to the first compressed air blast.

17. The method according to claim 10, further including suppressing the compressed air blast that is focused onto an available print sheet and conveying said print sheet out of the guide plane.

18. The method according to claim 10, wherein:

at least one segment of the compressed air device includes at least two first exit openings, having identically large cross-sectional surfaces, and at least two second exit openings with identically large cross-sectional surfaces that differ in size from the cross-sectional surfaces of the first exit openings; and the admitting step further includes: connecting said at least one segment to at least one control element and at least one other control element for changing the time interval during which the exit openings are admitted with compressed air and changing the cross-sectional surfaces of the exit openings, respectively, wherein the time interval for admitting the first and the second exit openings with compressed air are respectively changed by activating the first exit openings with the aid of the one control element and by activating the second exit openings with the aid of the other control element; and selectively changing the pressure of the compressed air supplied to the exit openings with at least one additional control element that is connected to the exit openings.

19. An apparatus for folding of a print sheet, comprising:

at least one first guide element defining a guide plane in which the print sheet is made available;

at least two folding rollers, arranged on a first side of the guide plane and respectively provided with one rotational axis, the rotational axes being oriented parallel to each other and substantially parallel to the guide plane, wherein a folding gap is defined between the at least two folding rollers for the print sheet to be folded when in a folding position over the folding gap;

a compressed air source;

a control unit;

a compressed air device arranged in a region of the folding gap on a second side of the guide plane opposite the first side of the guide plane and essentially parallel to the rotational axes of the folding rollers, wherein the compressed air device includes at least two segments respectively connected with the compressed air source and the control unit, each segment has at least one exit opening with a cross-sectional surface for the compressed air focused onto the folding gap, each segment has at least one control element coupled to the control unit, and each segment is configured to be separately activated with compressed air; and a transport device to move the print sheet in a feeding direction that extends essentially parallel to the rotational axes of the folding rollers, and the segments of the compressed air device are arranged one behind the other in the feeding direction, wherein the folding position comprises one first and one second folding position successively arranged spaced apart in the feeding direction; and at least first and second removal sections arranged downstream of the folding rollers, wherein the first removal section is configured to accommodate at least one print sheet in the first folding position and the second removal section is operative to accommodate at least one print sheet provided in the second folding position.

* * * * *